US007967109B2

(12) United States Patent
Petzl et al.

(10) Patent No.: US 7,967,109 B2
(45) Date of Patent: Jun. 28, 2011

(54) BELT FOR ROPING HARNESS EQUIPPED WITH A SALIENT EQUIPMENT-CARRYING DEVICE

(75) Inventors: Paul Petzl, Barraux (FR); Aurelie Leveque, Annecy (FR)

(73) Assignee: Zedel, Crolles (FR)

( * ) Notice: Subject to any disclaimer, the term of this patent is extended or adjusted under 35 U.S.C. 154(b) by 381 days.

(21) Appl. No.: 11/783,997

(22) Filed: Apr. 13, 2007

(65) Prior Publication Data

US 2007/0254542 A1 Nov. 1, 2007

(30) Foreign Application Priority Data

Apr. 26, 2006 (FR) ..... 06 03723

(51) Int. Cl.
*A47L 3/04* (2006.01)

(52) U.S. Cl. ..... 182/3; 182/6; 224/666; 224/660; 224/674; 2/338; 2/339; 2/241

(58) Field of Classification Search ..... 224/660, 224/250; 182/3, 6
See application file for complete search history.

(56) References Cited

U.S. PATENT DOCUMENTS 2,643,803 A * 6/1953 Bates ..... 224/254
4,273,215 A * 6/1981 Leggett ..... 182/3
4,318,502 A * 3/1982 Lowe et al. ..... 224/153
4,416,405 A * 11/1983 Caillouet ..... 224/257
4,446,997 A * 5/1984 Himberg ..... 224/578
4,587,818 A * 5/1986 Griffin ..... 70/457
5,145,027 A * 9/1992 Petzl et al. ..... 182/3
5,236,113 A * 8/1993 Wisser ..... 224/243
5,292,042 A * 3/1994 Yamaguchi et al. ..... 224/159
5,445,114 A * 8/1995 Walker ..... 119/857
5,492,256 A * 2/1996 Ive ..... 224/159
5,638,550 A * 6/1997 Hube ..... 2/311
5,890,640 A * 4/1999 Thompson ..... 224/630
5,896,859 A * 4/1999 Carroll ..... 128/845
5,992,352 A * 11/1999 Borchelt et al. ..... 119/856
6,015,073 A * 1/2000 Wojciak et al. ..... 224/251
6,024,265 A * 2/2000 Clements ..... 224/630
6,050,364 A * 4/2000 Popall et al. ..... 182/6
6,125,792 A * 10/2000 Gee ..... 119/770
6,244,486 B1 * 6/2001 Holland et al. ..... 224/584
6,264,081 B1 * 7/2001 Wojciak et al. ..... 224/251
6,345,745 B1 * 2/2002 Harriss ..... 224/158
6,364,186 B1 * 4/2002 Gilmour et al. ..... 224/637
6,374,946 B1 * 4/2002 Petzl et al. ..... 182/6
6,390,348 B1 * 5/2002 Godshaw et al. ..... 224/674
6,431,313 B1 * 8/2002 Petzl et al. ..... 182/6

(Continued)

FOREIGN PATENT DOCUMENTS

EP 0 736 310 A2 10/1996

(Continued)

*Primary Examiner* — Katherine Mitchell
*Assistant Examiner* — Candace L Bradford
(74) *Attorney, Agent, or Firm* — Oliff & Berridge, PLC

(57) ABSTRACT

A roping belt for a safety harness comprising an equipment-carrying device having at least one U-shaped attachment loop securedly fastened to the belt by fixing means and composed of a joining part made of flexible textile material and of a pre-formed stiffener part made of semi-rigid plastic. The joining part and the stiffener part are inserted in one another and are housed at least one of the ends thereof in a securing gusset fixed to the belt to form a non-articulated join biasing the equipment-carrying device to a salient position.

6 Claims, 8 Drawing Sheets

U.S. PATENT DOCUMENTS

| | | | | |
|---|---|---|---|---|
| 6,481,528 | B2 * | 11/2002 | Antonio | 182/6 |
| 6,869,146 | B2 * | 3/2005 | Gollahon | 297/468 |
| D558,402 | S * | 12/2007 | Petzl | D29/101.1 |
| 7,320,421 | B2 * | 1/2008 | Guminski | 224/268 |
| 2002/0162873 | A1 * | 11/2002 | Gilbert | 224/664 |
| 2003/0042284 | A1 * | 3/2003 | Reiserer | 224/660 |
| 2003/0052144 | A1 * | 3/2003 | Vardi | 224/258 |
| 2004/0065708 | A1 * | 4/2004 | Amram | 224/579 |
| 2005/0072530 | A1 * | 4/2005 | Petzl et al. | 160/3 |
| 2005/0263347 | A1 * | 12/2005 | Hill et al. | 182/3 |
| 2007/0095873 | A1 * | 5/2007 | Petzl et al. | 224/660 |
| 2007/0256890 | A1 * | 11/2007 | Petzl | 182/3 |
| 2009/0140020 | A1 * | 6/2009 | Schlipper | 224/257 |

FOREIGN PATENT DOCUMENTS

| | | | |
|---|---|---|---|
| WO | WO 02/28482 | A1 | 4/2002 |

* cited by examiner

BELT FOR ROPING HARNESS EQUIPPED WITH A SALIENT EQUIPMENT-CARRYING DEVICE

BACKGROUND OF THE INVENTION

The invention relates to a roping belt for a safety harness, comprising an equipment-carrying device having at least one U-shaped attachment loop securedly fastened to the belt by fixing means and composed of a joining part made of flexible textile material and of a pre-formed stiffener part made of semi-rigid plastic.

STATE OF THE ART

FIG. 1 shows a roping belt 10 of a safety harness comprising a lining structure 11 whereon a strengthening strap 12 is sewn over the whole length of the belt 10. The lining structure 11 is formed for example by a net fabric, a strip of synthetic material or a foam-based padded coating reinforced by biases. The belt 10 is equipped with an equipment-carrying device 13 formed by at least one U-shaped attachment loop 14 securedly fastened to the strengthening strap 12. The user can hook one or more pieces of safety equipment 15 onto the loop 14, in particular a carabiner, a descender, an ascender, etc. A main attachment loop 16 is arranged at the front of the strengthening strap 12 to join the belt 10 of the harness to a safety rope.

FIG. 2 represents a first known embodiment of an equipment-carrying device 13 which is made from a relatively tender deformable material and is in the form of a U-shaped loop. The ends of the U-shaped loop are provided with fixing patches 17 wherethrough seams 18 are sewn to fasten the equipment-carrying device to the strengthening strap 12. The mechanical strength of such an equipment-carrying device is limited on account of the perforation of the material by the seams 18 at the level of the attachment patches 17.

FIG. 3 illustrates a second known embodiment of an equipment-carrying device 13 which comprises a strengthening part 19 made of textile sewn onto the two ends of the strap 12 and forming a loop. Shaping of the equipment-carrying device 13 is achieved by deformation of a tubular semi-rigid stiffener part 20 inside which the strengthening part 19 is first inserted.

FIG. 4 shows the reverse arrangement of the equipment-carrying device 13 wherein the semi-rigid stiffener part 20 is formed by an insert housed inside a tubular textile sleeve forming the strengthening part 19. The internal stiffener part 20 is shorter than the external flexible sleeve, and the seams 18 are made in the strap 12 passing through the ends of the sleeve, but not the stiffener part 20.

The mechanical strength of the equipment-carrying device 13 is high in both the cases of FIGS. 3 and 4, but the join with the belt is too flexible at the level of the flexion lines 21 so that the device prefers to position itself in the vertical position. This results in difficulties in hooking pieces of equipment thereon, this often requiring the use of both hands.

OBJECT OF THE INVENTION

The object of the invention is to achieve a roping belt equipped with an equipment-carrying device having a strong binding join enabling pieces of equipment to be hooked on with one hand.

The belt according to the invention is characterized in that the joining part and the stiffener part are inserted in one another and are housed at least one of the ends thereof in a securing gusset fixed to the belt to form a non-articulated join biasing the equipment-carrying device to a salient position.

According to a preferred embodiment, the securing gusset is formed by a rigidifying part sewn onto the belt and provided with a belt ring acting as bearing for the end of the stiffener part. The non-articulated join advantageously forms an embedded join on at least one of the sides.

An equipment carrier is thus obtained whose join with the belt is very strong, not too flexible so as to remain salient for ease of hooking pieces of equipment thereon, and not too rigid so as not to hurt the harness wearer.

The stiffener part of the equipment-carrying device can be disposed inside a tubular sleeve constituting the textile joining part. The sleeve is then longer than the stiffener part, each end of the sleeve being sewn onto the belt up-line from the gusset.

The textile joining part can be formed by an auxiliary strap housed inside a semi-rigid external tube constituting the deformable stiffener part. The auxiliary strap is longer than the tube, each end whereof is housed in the corresponding gusset.

BRIEF DESCRIPTION OF THE DRAWINGS

Other advantages and features of the invention will become more clearly apparent from the following description of particular embodiments of the invention given as non-restrictive examples only and represented in the accompanying drawings, in which.

DETAILED DESCRIPTION OF THE INVENTION

Figure 1:
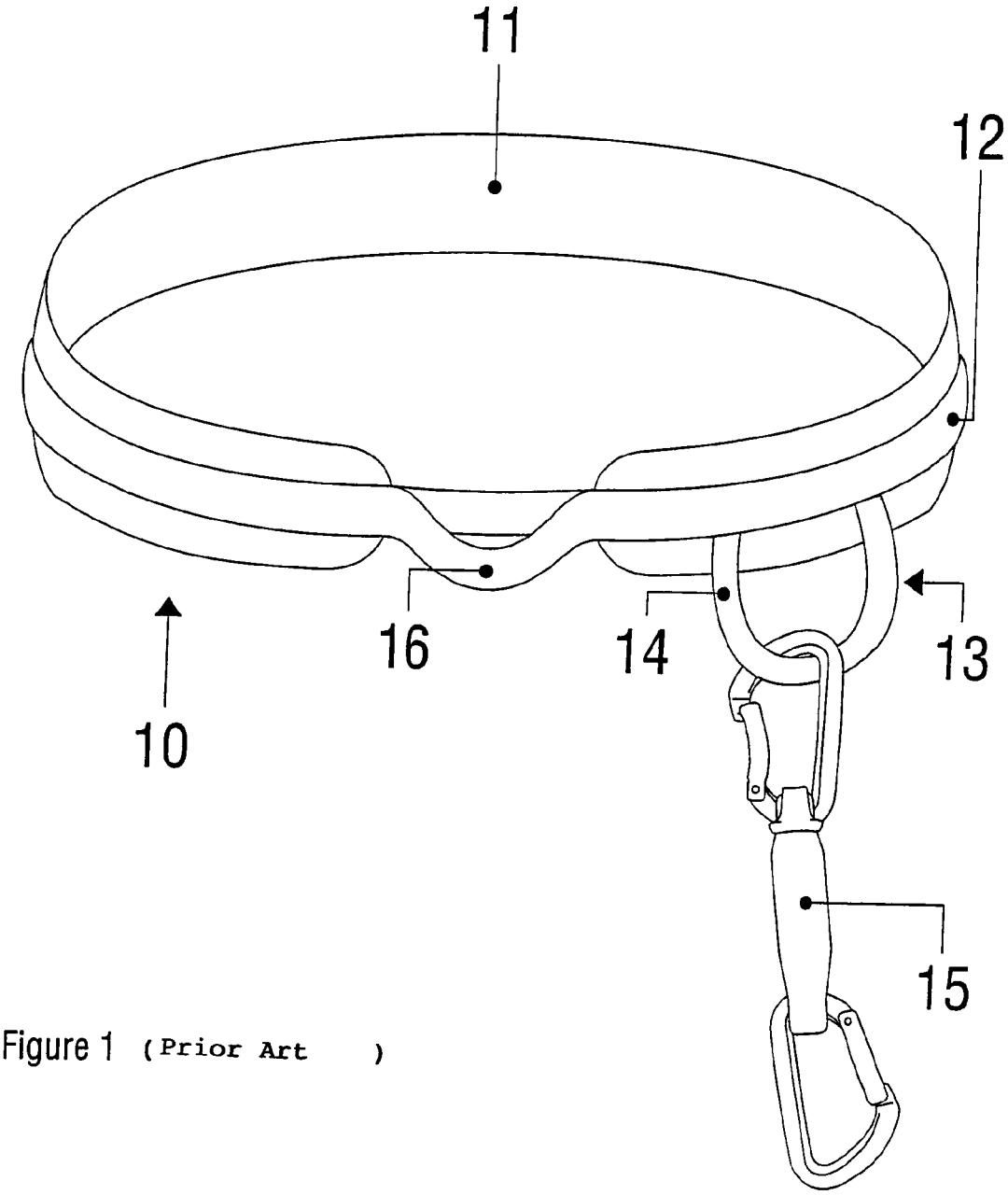
Figure 1 (Prior Art)
FIG. 1 shows a schematic view of a belt equipped with an equipment-carrying device according to the prior art.
Figure 2:
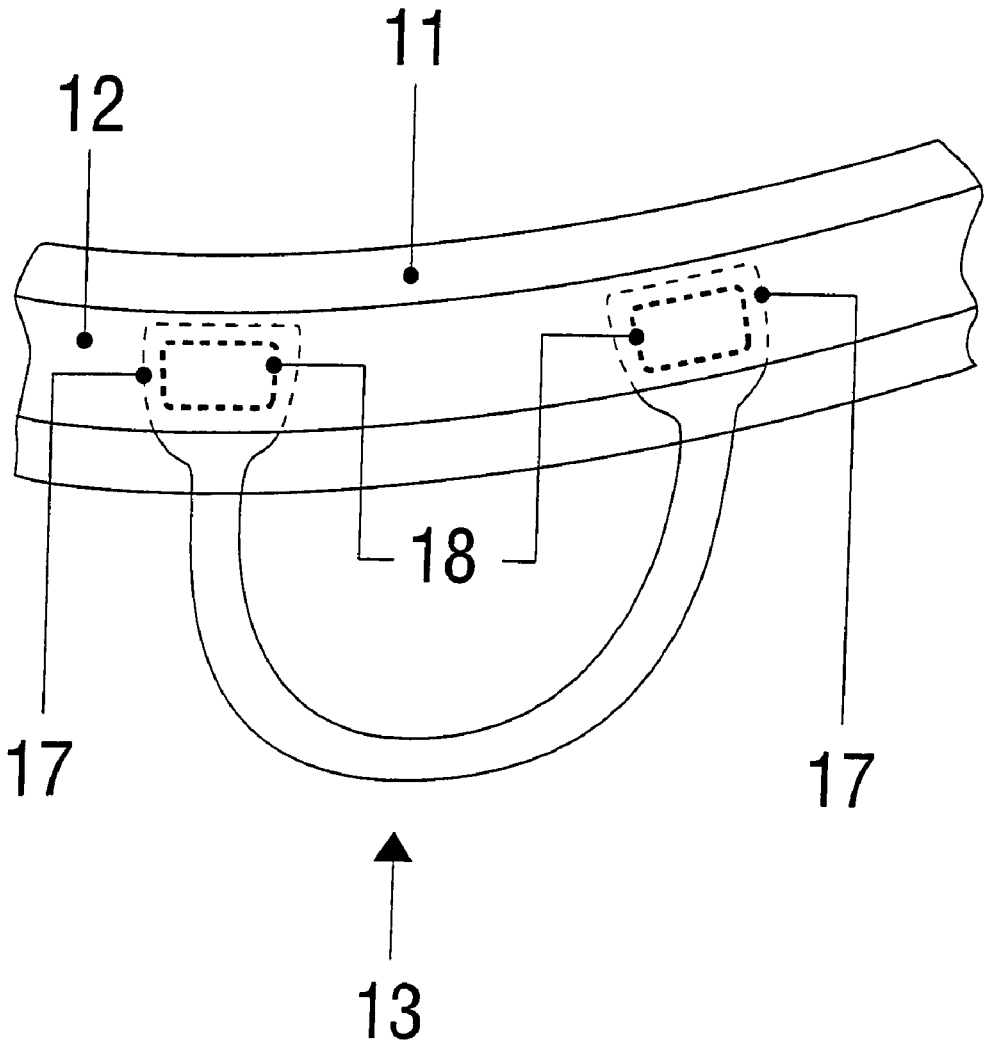
Figure 2 (Prior Art)
FIGS. 2, 3 and 4 are identical schematic views of three equipment-carrying devices according to the prior art.
Figure 3:
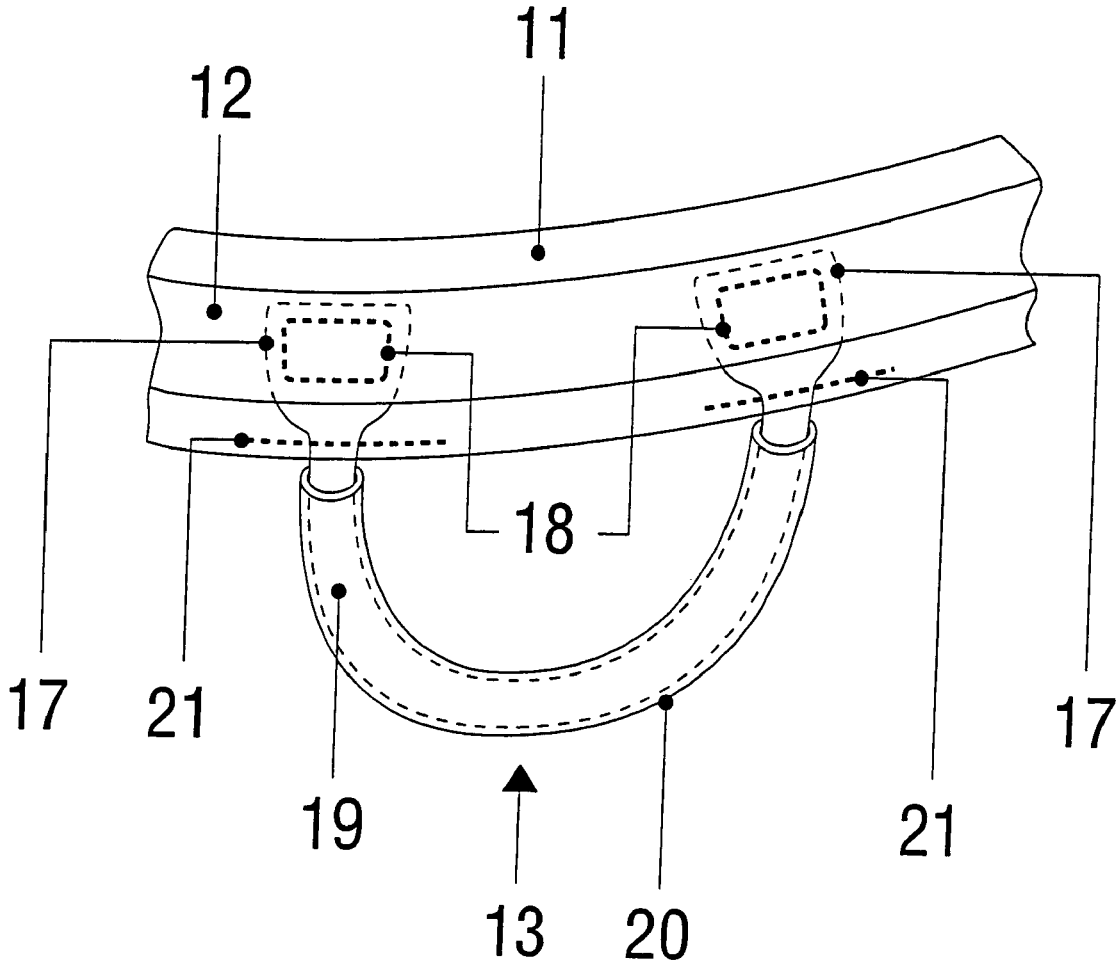
Figure 3 ( Prior Art )
Figure 4:
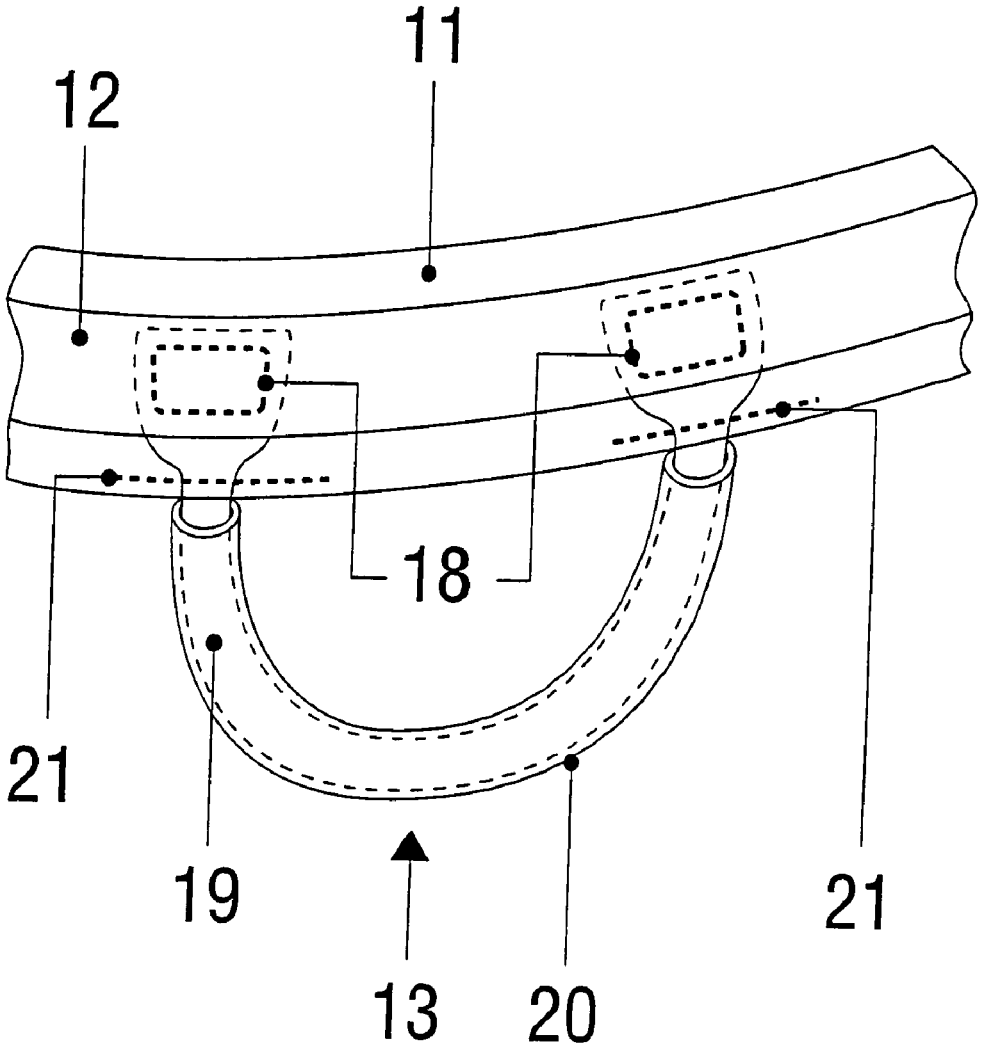
Figure 4 (Prior Art)
Figure 5:
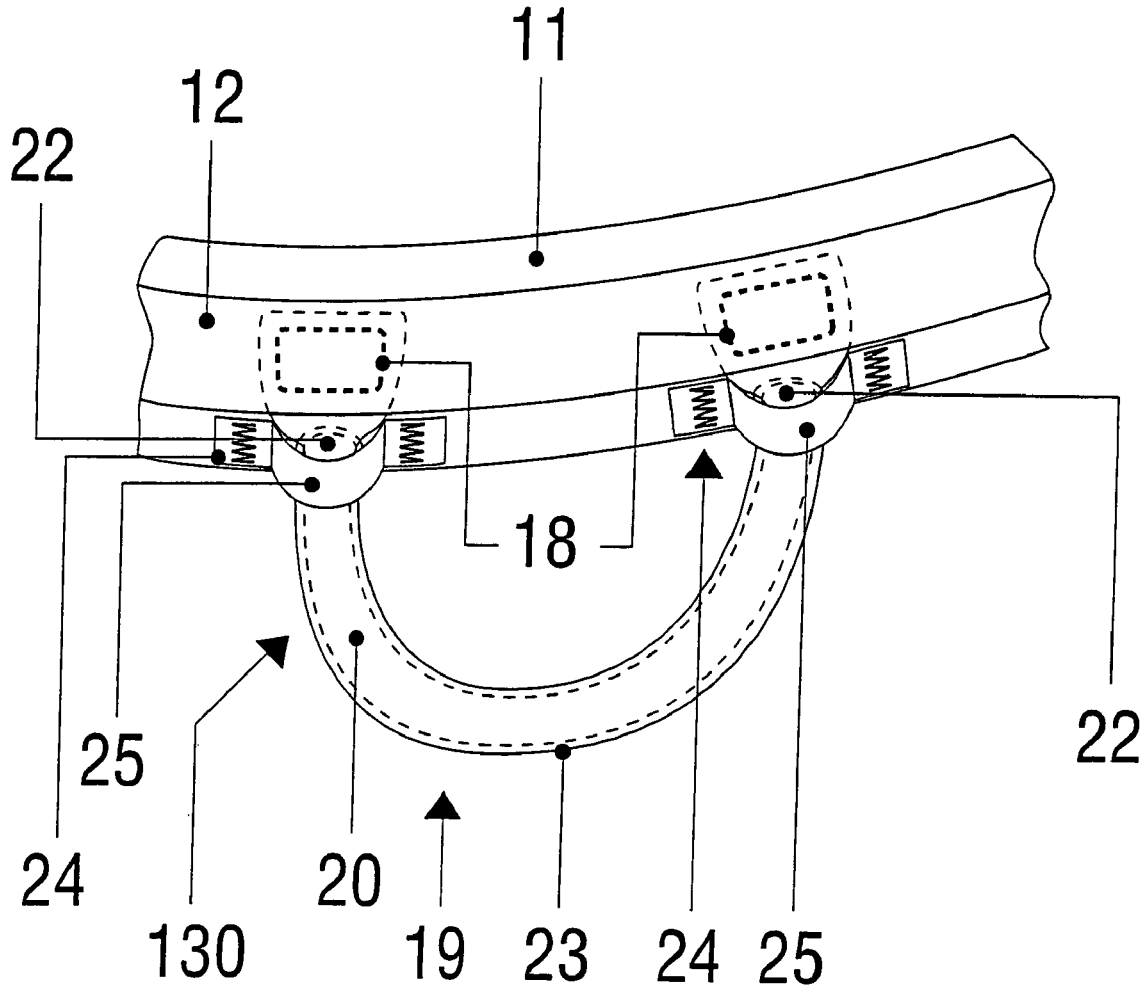
FIGS. 5 to 7 represent schematic views of three embodiments of equipment-carrying devices according to the invention.
Figure 6:
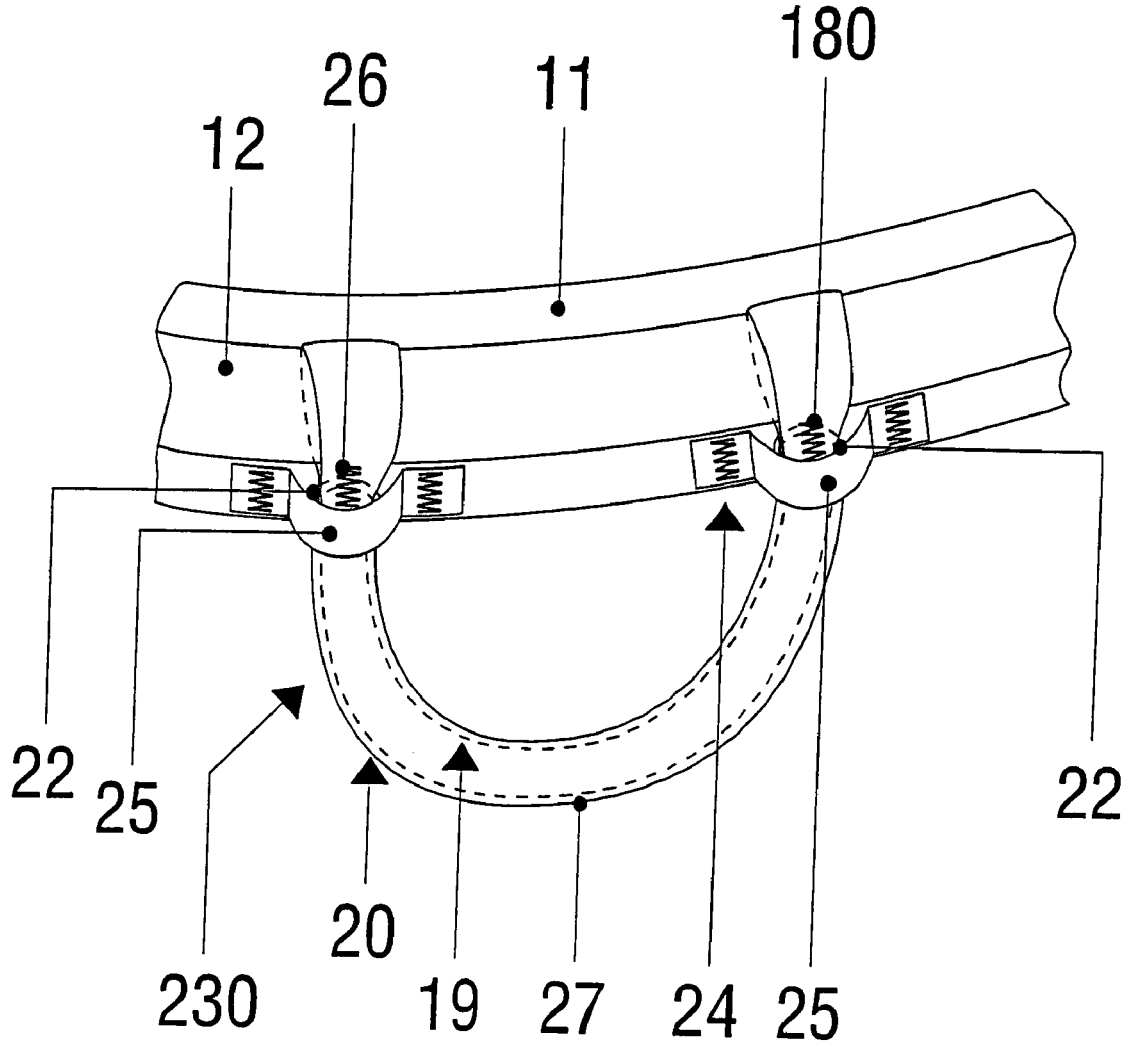
Figure 7:
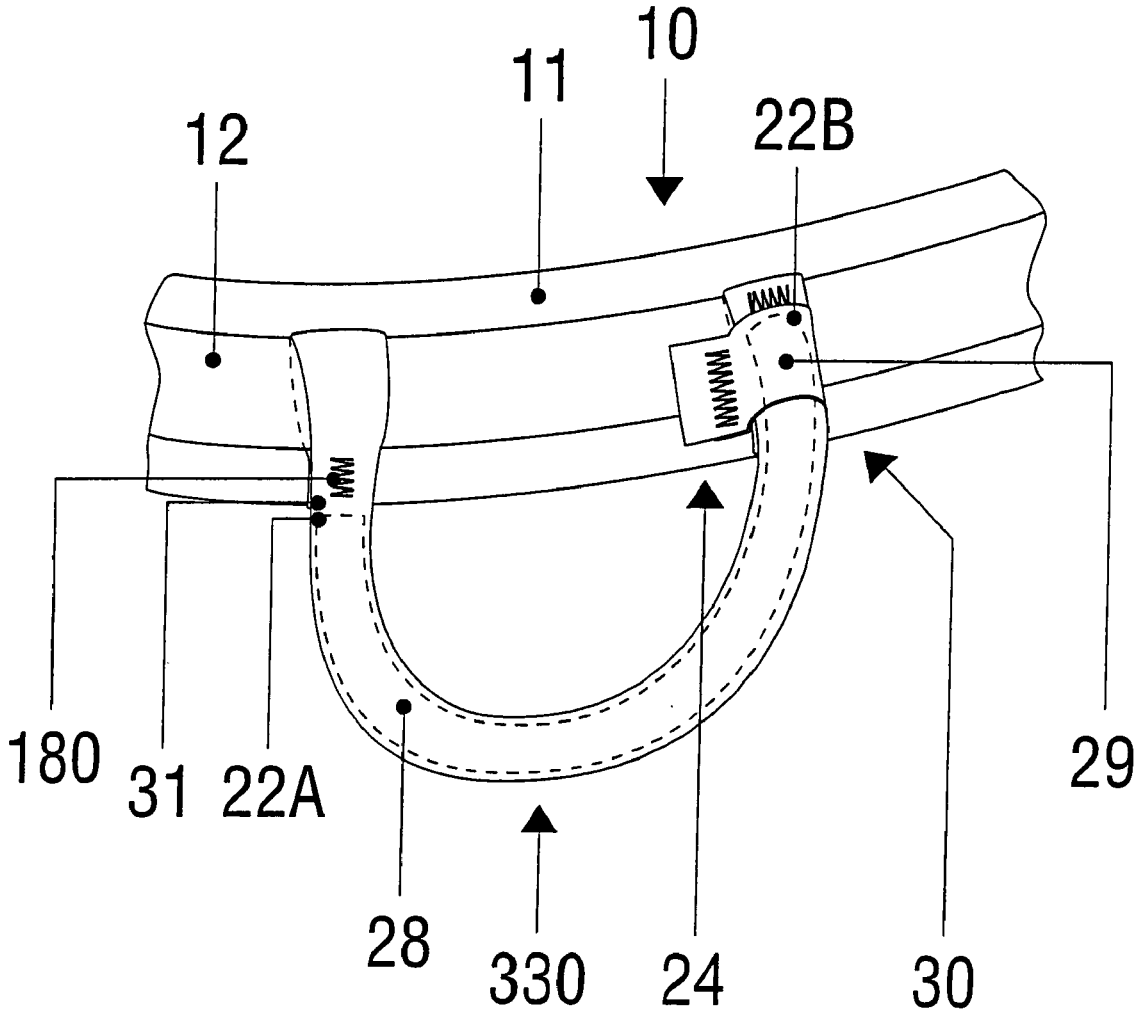

In FIGS. 5 to 7, the same reference numbers will be used to designate identical or similar parts to those of FIGS. 1 to 4.

With reference to FIG. 5, the equipment-carrying device 130 is composed of a joining part 19 formed by a tubular sleeve 23 made of strong textile material and of a semi-rigid stiffener part 20 arranged inside the sleeve 23 to perform U-shaping. The two ends of the textile sleeve 23 extend beyond the two ends 22 of the stiffener part 20 and are sewn directly onto the strengthening strap 12 by means of seams 18.

Each end 22 of the stiffener part 20 is located back from the corresponding seam 18 inside the textile sleeve 23. A strengthening gusset 24 is sewn onto the lining structure 11 and comprises a belt ring 25 wherein each end 22 of the stiffener part 20 surrounded by the sleeve 23 is housed.

The stiffener part 20 inside the textile sleeve 23 is shaped in such a way as to keep the equipment-carrier 130 salient to make it easier to hook pieces of equipment thereon. The presence of the gussets 24 around the ends 22 of the stiffener part 20 eliminates any flexion effect without constituting a rigid join.

In FIG. 6 illustrating the equipment-carrying device 230, the joining part 19 made of textile is formed by an auxiliary strap 26 housed inside a semi-rigid external tube 27 constituting the deformable stiffener part 20. The auxiliary strap 26 is longer than the tube 27 and the strengthening gussets 24 surround each end 22 of the tube 27. The ends of the auxiliary strap 26 pass over the strengthening strap 12 and are securedly fastened to the lining structure 11 by seams 180.

In FIG. 7, the equipment-carrying device 330 comprises a semi-rigid insert 28 housed inside a tubular textile joining part 19. The insert 28 is shorter on the left-hand side where the end of the tubular textile joining part 19 is securedly fastened directly to the strengthening strap 12 as in FIG. 6. The end 22A of the insert 28 is laid back from the seam 180.

On the right-hand side, the semi-rigid insert 28 has an extension 29 extending in the belt ring of the gusset 24 to position the end 22B at a higher level than that of the other end 22A. The end of the tubular textile joining part 19 is securedly fastened directly to the strengthening strap 12.

The equipment-carrying device 330 thereby has an embedded join 30 on the right-hand side guaranteeing that it is kept salient, and a flexible join 31 on the left-hand side enabling a good multidirectional strength to be achieved.

Figure 8:
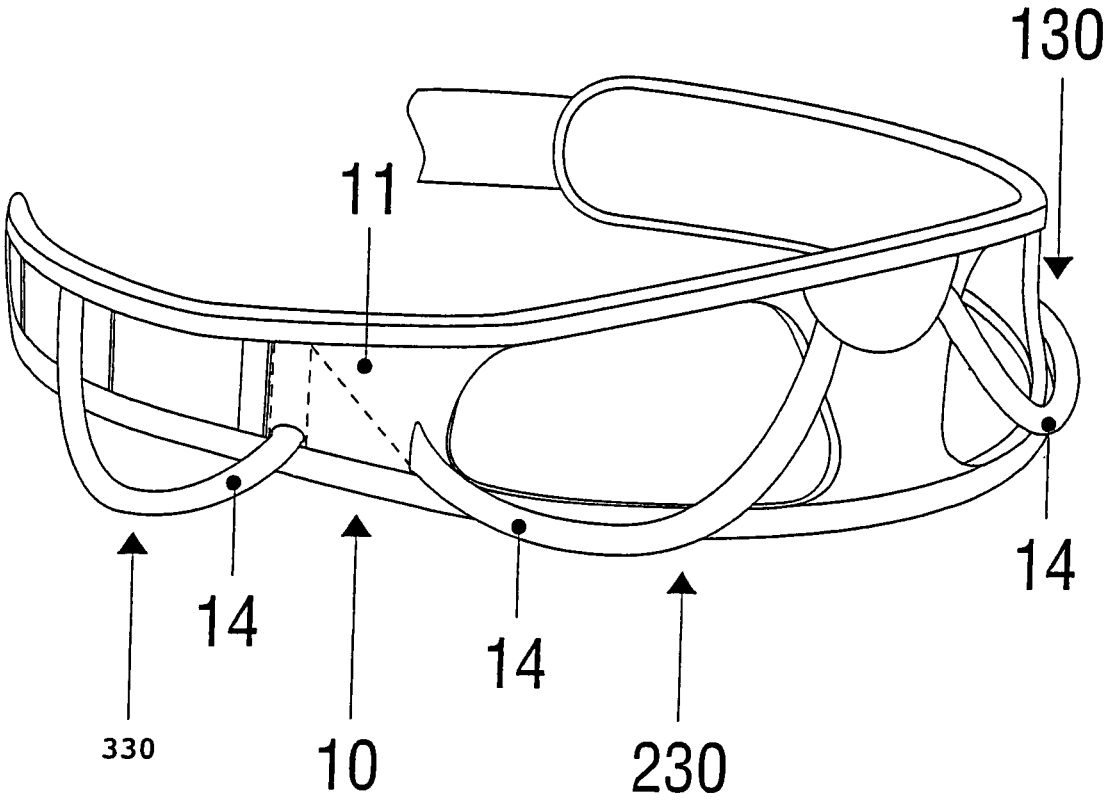
FIG. 8 illustrates a perspective view of a belt with the equipment-carrying devices according to the invention.

FIG. 8 shows a belt 10 according to the invention equipped with three hook-on loops 14 belonging to each type of above-mentioned equipment-carrying devices 130, 230, 330. It can be noted that the three loops 14 are salient from the lining structure 11 of the belt 10 to make it easy to hook pieces of equipment thereon.

The invention claimed is:

1. A harness belt strap, comprising:

a strap;

a U-shaped equipment carrying device, comprising:

an elongated substantially cylindrical flexible joining part having first and second ends that are each secured to the strap at first and second securing locations, respectively, wherein a distance between the first and second securing locations is a distance shorter than a total length of the joining part, such that the joining part forms a U-shape when secured to the strap, and an elongated substantially cylindrical stiffener part that is disposed coaxial and integral with the joining part between the first and second securing locations, the stiffener part having first and second ends that are set back, respectively from the first and second securing locations;

wherein the first securing location is located on the strap such that the first end portion of the stiffener part rests on the strap and causes the U-shaped part of the joining part to be biased at an angle away from a plane of the strap, and the second securing location lay flat against the strap and the other end portion of the stiffener part does not extend over the strap or into the 2nd securing location.

2. The harness belt strap according to claim 1, wherein the stiffener part of the equipment-carrying device is disposed inside a tubular sleeve constituting the joining part.

3. The harness belt strap according to claim 2, wherein the tubular sleeve is longer than the stiffener part, and a first end of the tubular sleeve is sewn onto the strap with a seam above a centerline of the strap.

4. The harness belt strap according to claim 1, wherein the joining part includes an auxiliary strap housed inside a semi-rigid external tube constituting the stiffener part.

5. The harness belt strap according to claim 1, further comprising a gusset secured to the harness belt strap and housing the equipment carrying device in a vicinity of the first end of the stiffener part.

6. The harness belt strap according to claim 1, wherein the second end of the stiffener part is set back from an edge of the strap.

* * * * *